United States Patent [19]

Brown

[11] Patent Number: 4,583,649

[45] Date of Patent: Apr. 22, 1986

[54] LINE LOCK

[75] Inventor: John A. S. Brown, Edwardstown, Australia

[73] Assignee: Hills Industries Limited, Edwardstown, Australia

[21] Appl. No.: 674,579

[22] Filed: Nov. 26, 1984

[30] Foreign Application Priority Data

Nov. 24, 1983 [AU] Australia ..... PG2544

[51] Int. Cl.[4] ..... A47F 5/00

[52] U.S. Cl. ..... 211/183; 24/129 B; 211/119.15; 211/197

[58] Field of Search ..... 211/183, 119.01, 119.15, 211/197, 205, 119.1; 248/353; 24/129 R, 129 B, 129 D

[56] References Cited

U.S. PATENT DOCUMENTS

| | | | |
|---|---|---|---|
| 2,474,922 | 7/1949 | Unwin | 211/197 X |
| 2,503,386 | 4/1950 | Griffin | 211/197 |
| 2,707,091 | 4/1955 | Reeder | 248/353 |
| 2,721,891 | 10/1955 | Kersten | 248/353 |
| 2,742,253 | 4/1956 | July | 248/353 |
| 2,954,631 | 10/1960 | McMurray | 24/129 X |
| 3,409,014 | 11/1968 | Shannon | 24/129 B X |

*Primary Examiner*—Robert W. Gibson, Jr.

*Attorney, Agent, or Firm*—Henry Sternberg; Bert J. Lewen

[57] ABSTRACT

A line lock for a rotary clothes dryer includes a locking block having a socket which is positioned over an end of, and engages, an arm of a rotary clothes dryer, a plurality of apertures extending through the block, at least one of the clothes lines extending through an aperture, and a flexible line tie extending through another of the apertures, and being tied to the clothes line thereby locking the clothes line to the locking block.

5 Claims, 6 Drawing Figures

LINE LOCK

This invention relates to a line lock which is effective in reducing the transverse loading on the arms of a rotary clothes hoist or dryer.

BACKGROUND OF THE INVENTION

When a rotary clothes hoist or dryer is loaded, for example along one side, with heavy wet clothes to be dried, and rotation is effected by applying a force to the end of another arm, quite large stresses can be imposed on the inner end of that other arm because of the great deal of leverage (mechanical advantage) which exists. One object of this invention is to provide an effective means whereby the arms are tied together in such a way that the stress is greatly reduced, and in one example of this invention, a rotary clothes line is provided with locking blocks one on the end of each of the arms of a rotary clothes hoist, and locking means on each said block which locks a clothes line against relative displacement. Since the clothes lines are normally under some tension, the locking blocks can conveniently be positioned over the ends of respective arms and the outermost line will then retain them in position. The engaging means between the locking block and the clothes line can take any one of a number of forms, but in one embodiment each locking block has a portion containing a plurality of apertures, the line passing through one of the apertures and tie means looping over the line passing through another of the apertures, the tie means locking the line against displacement with respect to the locking block.

BRIEF SUMMARY OF THE INVENTION

In this invention, a line lock for a rotary clothes dryer includes a locking block having a socket which is positioned over an end of, and engages, an arm of a rotary clothes dryer, a plurality of apertures extending through the block, at least one of the clothes lines extending through an aperture, and a flexible line tie extending through another of the apertures, and being tied to the clothes line thereby locking the clothes line to the locking block.

Where a block is located intermediate the ends of a line, the line lock can be looped over the line on each respective side of the block, passing through three of the apertures, and when tightened will kink the clothes line each side of the block.

Where the block is located at the ends of a line, each end of the line itself may be looped over the adjacent other end, and passed back through a respective aperture, and, in this second mode, the clothes line is kinked on each side of the block.

BRIEF DESCRIPTION OF THE DRAWINGS

An embodiment of the invention is described hereunder in some detail with reference to, and is illustrated in, the accompanying drawings, in which.

Figure 1:
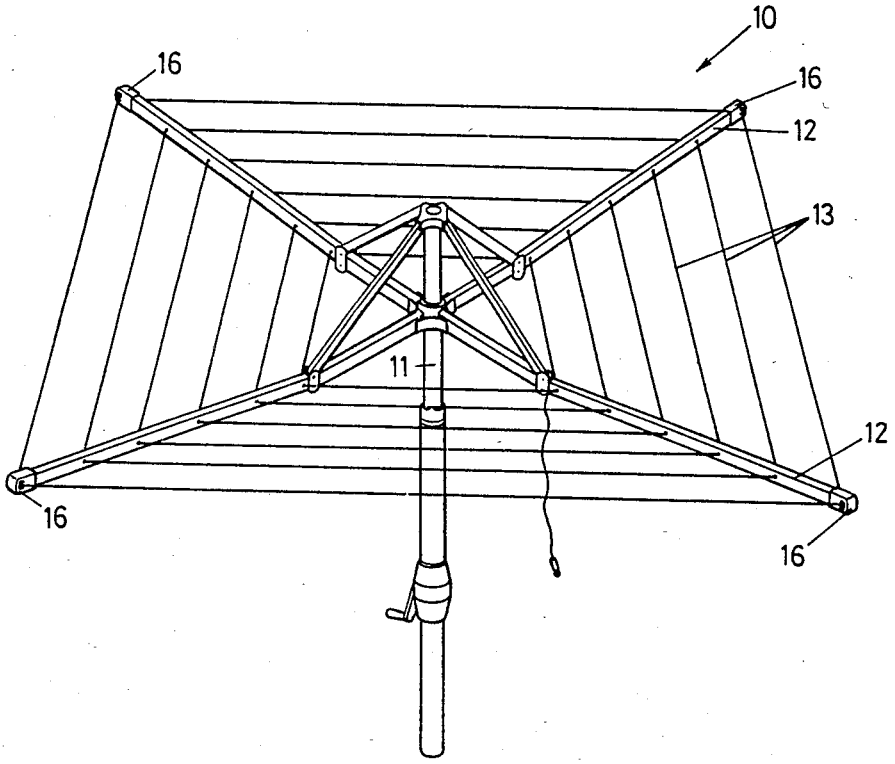
FIG. 1 is a perspective view of a rotary clothes dryer having radiating arms which carry clothes lines.
Figure 2:
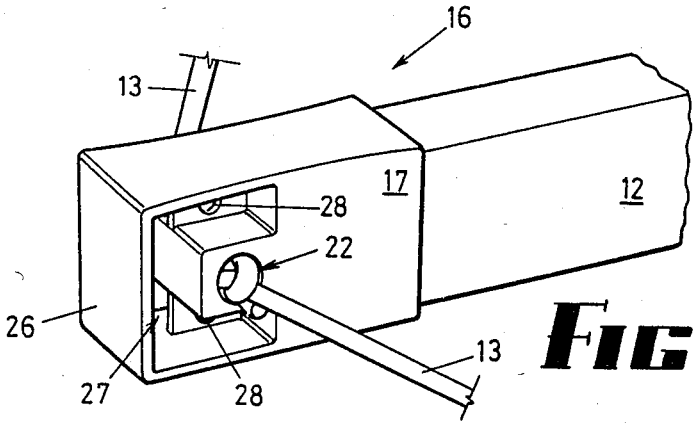
FIG. 2 is a fragmentary view of a locking block positioned over the end of a clothes dryer arm.
Figure 3:
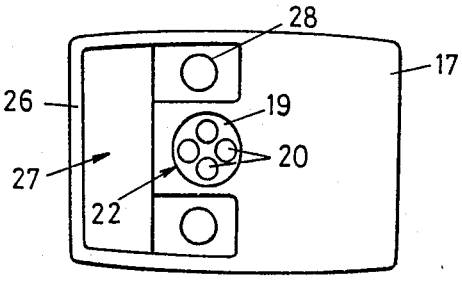
FIG. 3 is a side elevation of a locking block.
Figure 4:
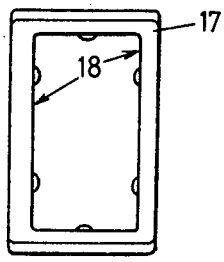
FIG. 4 is an end elevation of FIG. 3.

In this embodiment a rotary clothes dryer 10 is made in accordance with known art, having a central stem 11 which will rotate, four arms 12 radiating from the central stem 11, and a plurality of clothes lines 13 interconnecting the arms.

The outermost of the clothes lines is locked to the outer end of each arm by means of a respective line lock 16.

Each line lock 16 comprises a locking block 17 which is positioned on the end of a respective arm. The locking block 17 has surfaces defining socket walls 18, and these firmly engage the locking block on the end of arm 12. To prevent withdrawal however, the locking block comprises a central web 19 (shown dotted in FIGS. 5 and 6), and four tie apertures 20 which extend through that central apertured tie web 19 in an extending portion of the locking block, and the outermost clothes line passes through at least one tie aperture 20.

The apertured web 19 is positioned centrally on a vertical plane with respect to the locking block, and this web lies between two housing recesses 22 extending from opposite side walls of the locking block.

Figure 5:
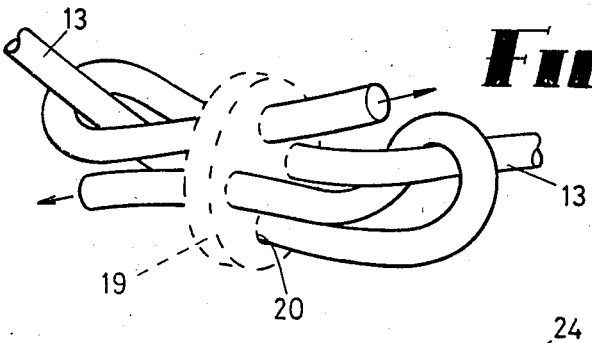
FIG. 5 is a diagrammatic view showing the configuration of the line lock where a block is located intermediate the ends of a line.

As shown in FIG. 5, each line 13 passes through a respective tie aperture 20 in the web 19 of one of the locking blocks 17, loops over the other line, and its tail end then passes through another aperture. In this way, the ends of the line are joined simply and neatly.

Figure 6:
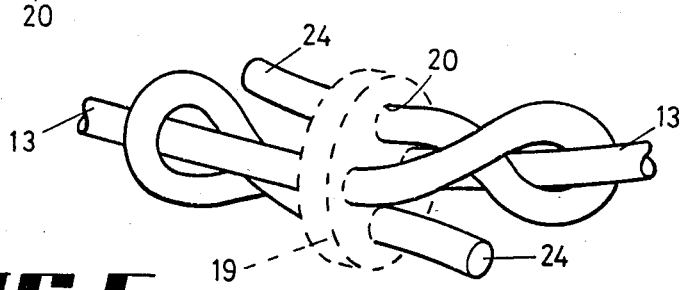
FIG. 6 is a diagrammatic view showing the configuration of the line lock where a block is located at the ends of a line.

As shown in FIG. 6, a short length of line or cord, 13 (which can be identical to the line 24 in its size and composition) is firstly passed through one of the tie apertures 20, looped over the line 13 on one side of the locking block 17, and back through another of the tie apertures 20. The other end also passes back through another of the tie apertures 20. The tie apertures and the line aperture lie on a pitch circle, and therefore the arrangement is such that when the tie ends are pulled, they kink the line and thereby firmly lock it against relative movement with respect to the locking block.

Quite frequently there is a need in a clothes line assembly for means for hanging a clothes hanger or other device, and in this embodiment each locking block 17 extends to have an outermost web 26 the inner wall of which defines a hanging aperture 27 for supporting a clothes hanger for example. Further hanging apertures 28 are also provided above and below the central apertured web 19.

A brief consideration of the above embodiment will indicate that the invention provides an excellent mean whereby stress can be rcduced on the radiating arms of a clothes hoist or dryer. Although alternative configurations can be used for retaining the outermost line against dislodgement with respect to the locking block, for example recesses containing barbed edges, nevertheless it will be appreciated that the preferred embodiment description provides a locking block which is very easily produced and applied and which is of low cost. Furthermore it will be seen that the line which is used for stay or guy wire purposes is not necessarily the outermost line, but the invention can also be applied by locking intermediate lines, for example using collets.

I claim:

1. A line lock on a rotary clothes dryer having radiating arms which carry clothes lines, comprising a locking block, walls of the locking block defining a socket positioned over a said arm with said walls engaging said arm end, surfaces defining a plurality of tie apertures extending through the block, at least one of the clothes lines extending through a respective one of the tie apertures, and flexible line tie means extending through at least one other of the tie apertures, the tie means being tied to said one of the clothes lines and locking that said clothes line to the locking block.

2. A line block according to claim 1 wherein the locking block further comprises a tie web, there being four said tie apertures which extend through that said tie web.

3. A line lock according to claim 2 wherein a tail end of each of two said flexible lines extends through respective apertures of two of said tie apertures, the tail end of each line looping over the other line, and passing back through another of said tie line apertures.

4. A line lock according to claim 2 wherein the locking block comprises walls defining two housing recesses which extend in opposite directions from the tie web.

5. A line lock according to claim 1 wherein the locking block comprises extending walls which define a hanging aperture.

* * * * *